US006428378B2

(12) United States Patent
Tjaden et al.

(10) Patent No.: US 6,428,378 B2
(45) **Date of Patent: *Aug. 6, 2002**

(54) COMPOSITE SELF-ALIGNED EXTRACTION GRID AND IN-PLANE FOCUSING RING, AND METHOD OF MANUFACTURE

(75) Inventors: Kevin W. Tjaden; Terry N. Williams, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/778,316

(22) Filed: Feb. 6, 2001

Related U.S. Application Data

(63) Continuation of application No. 09/109,955, filed on Jul. 2, 1998, now Pat. No. 6,190,223.

(51) Int. Cl.[7] ..... H01J 9/02
(52) U.S. Cl. ..... 445/24
(58) Field of Search ..... 445/24

(56) References Cited

U.S. PATENT DOCUMENTS

| | | | | |
|---|---|---|---|---|
| 3,970,887 A | | 7/1976 | Smith et al. | 313/309 |
| 4,874,981 A | | 10/1989 | Spindt | 313/39 |
| 4,940,916 A | | 7/1990 | Borel et al. | 313/306 |
| 5,012,153 A | | 4/1991 | Atkinson et al. | 313/336 |
| 5,186,670 A | | 2/1993 | Doan et al. | 445/24 |
| 5,191,217 A | | 3/1993 | Kane et al. | 250/423 |
| 5,212,426 A | | 5/1993 | Kane | 315/169.1 |
| 5,229,331 A | | 7/1993 | Doan et al. | 437/228 |
| 5,259,799 A | * | 11/1993 | Doan et al. | 445/24 |
| 5,283,500 A | | 2/1994 | Kochanski | 315/58 |
| 5,374,868 A | | 12/1994 | Tjaden et al. | 313/310 |
| 5,378,963 A | | 1/1995 | Ikeda | 313/495 |
| 5,653,619 A | * | 8/1997 | Cloud et al. | 445/24 |
| 5,973,445 A | * | 10/1999 | Watkins | 445/41 |
| 5,977,696 A | * | 11/1999 | Okamoto et al. | 313/309 |
| 6,190,223 B1 | * | 2/2001 | Tjaden et al. | 445/24 |
| 6,224,447 B1 | * | 5/2001 | Moradi et al. | 445/24 |

OTHER PUBLICATIONS

Tang et al., "Theory and Experiment of Field–Emitter Arrays with Planar Lens Focusing", in Eighth International Vacuum Microelectronics Conference Technical Digest, Electron Devices society, Portland, Oregon, Jul. 30–Aug. 3, 1995, pp. 77–79.

Kesling and Hunt, "Beam Focusing for Field Emission Flat Panel Displays," 7$^{th}$ International Vacuum Microelectronics Conference, Societe Francaise du Vide, Grenoble, France, Jul. 4–7, 1994, pp. 135–138.

* cited by examiner

*Primary Examiner*—Kenneth J. Ramsey
(74) *Attorney, Agent, or Firm*—Dorsey & Whitney LLP

(57) ABSTRACT

A field emission display having a base plate which has a focus ring structure substantially planar with the extraction grid. The field emission display base plate is fabricated on a substrate having a cathode including an emitter tip formed thereon by depositing a first insulating layer, a first conductive layer over the first insulating layer, etching the first conductive layer, depositing a second insulating layer over the etched first conductive layer, and depositing a second conductive or focus ring layer over the second insulating layer. A second selective etching may be formed to further define the gate and focus ring structures.

40 Claims, 7 Drawing Sheets

COMPOSITE SELF-ALIGNED EXTRACTION GRID AND IN-PLANE FOCUSING RING, AND METHOD OF MANUFACTURE

CROSS-REFERENCE TO RELATED APPLICATION

This application is a continuation of U.S. patent application Ser. No. 09/109/955, filed Jul. 2, 1998, now U.S. Pat. No. 6,190,223.

TECHNICAL FIELD

This invention relates to field emission devices, and more particularly to processes for creating gate and focus ring structures which are self-aligned to emitter tips using chemical mechanical planarization (CMP) and etching techniques.

BACKGROUND OF THE INVENTION

Flat panel displays have become increasingly important in appliances requiring lightweight portable screens. Currently, such screens generally use electroluminescent or liquid crystal technology. A relatively new technology is the field emission display which uses of a matrix-addressable array of cold cathode emission devices to excite cathodoluminescent material on a screen.

With reference to FIG. 1, a conventional field emission display 10 includes a base plate 12 and a face plate 24 spaced from each other to define a sealed envelope 11 therebetween. The sealed envelope 11 may be evacuated as is conventional in field emission displays.

The base plate 12 may include a substrate 18 of silicon or some other material on which a conductive layer 20 is formed, the conductive layer 20 supporting a plurality of conical emitters 22. Only one emitter 22 has been shown to simplify the discussion. An extraction grid 16 formed of a conducting material is positioned above the substrate 18 by a first insulating layer 26 of dielectric material. Each emitter 22 extends into a respective aperture 31 formed in the extraction grid 16. A focus ring layer 14 is positioned over the extraction grid 16. The focus ring layer 14 is also formed of a conductive material and is spaced from the extraction grid 16 by a second insulating layer 28 of a dielectric material. A plurality of apertures 33 are formed in the focus ring layer 14, each aperture 33 aligned with a respective aperture 31 formed in the extraction grid 16.

The face plate 24 includes a transparent substrate 38 coated with a transparent layer of conductive material 40, such as iridium, forming an anode 36. The anode 36 is, in turn, coated with a layer of cathodoluminescent material 42.

In practice, the emitters 22 (which may be in sets of interconnected emitters) are arranged in columns while individual extraction grids 16 are arranged in rows. An individual emitter 22 can then be selected for electron emission by driving a column of emitters 22 to a relatively low voltage and driving an extraction grid 16 row to a relatively high voltage. Electrons 34 are emitted from the emitter 22 in the energized column of emitters 22 that intersects with the energized extraction grid 16 row.

A relatively high positive voltage on the order of 1000 volts is applied to the anode layer 40. The strong positive voltage attracts the electrons 34 emitted by the emitter 22 so that they pass through the focus ring 14 and strike the cathodoluminescent layer 42. The cathodoluminescent layer 42 then emits light which is visible through the transparent substrate 38.

While the focus ring 50 nominally serves the function of collimating the electron beam 34, the primary purpose of the focus ring layer 14 is to protect the underlying structure from electromagnetic radiation such as soft x-rays and ultraviolet radiation, thus serving as an opaque. Ultraviolet radiation and soft x-rays result from back-scattering from the emitted electrons 34 striking the cathodoluminescent layer 42, resulting in some of the electromagnetic radiation being reflected back toward the back plate 12 from the face plate 24.

The clarity, or resolution, of a field emission display is a function of a number of factors, including emitter tip sharpness, alignment and spacing of the gates, or grid openings 31, which surround the emitter tips 22, pixel size, as well, as cathode-to-gate and cathode-to-screen voltages. Another factor which affects image sharpness is the angle at which the emitted electrons 34 strike the phosphors 42 of the display screen 36.

The distance that the emitted electrons 34 must travel from the base plate 12 to the face plate 24 is typically on the order of several hundred microns. The contrast and brightness of the display are optimized when the emitted electrons 34 impinge on the phosphors 42 located on the cathode luminescent screen 36 or face plate 24, at a substantially 90° angle. However, the contrast and brightness of the display are not currently optimized due to the fact that the initial electron trajectories assumes substantially conical patterns having an apex angle of roughly 30°, which emanates from the emitter tip 22. In addition, the space-charge affect results in coulombic repulsion among emitted electrons 34, which lends to further dispersion within the electron beam 34. Even though the focus rings 50 are normally maintained at ground, they will exert a force on the emitted electrons 34. Since the focus rings 50 are spaced relatively above and outward of the gate structures 30 the force exerted will contribute to the dispersion of the emitted electrons 34.

The current design and positioning of focus ring layer 14 causes several problems. The position of the focus ring 50 which is spaced relatively above the low potential anode or extraction grid 16 with respect to the cathode luminescent panel 36 tends to further disperse the emitted electron beam 34. The current method of fabricating the base plate 12 of the field emission display device 10 requires one CMP step and three etching steps which increases the cost and time required to produce the field emission display. Further, the substantial gap between the extraction grid 16 and the focus ring 50 required by the existing design increases the likelihood of electromagnetic radiation leakage past the opaque.

SUMMARY OF THE INVENTION

The present invention overcomes the limitations of the prior art by providing a flat panel display structure having a focus ring which lies in substantially the same plane as the extraction grid. The base plate of the field emission display is manufactured by covering an emitter substrate having emitters tips with a dielectric insulating material to form a first insulating layer, depositing an extraction grid layer over the first insulating layer, etching the extraction grid layer to define a plurality of gate structures, depositing a second insulating layer over the etched structure, depositing a focus ring layer, and chemical-mechanical planarizing the resulting structure to an endpoint at which the emitter tips are at least partially exposed, thus defining self-aligned and in-plane gate and focus ring structures. The structure may then be optionally selectively wet etched to remove portions of the first and second insulating layers for further exposing the emitter tips.

The base plate includes a substrate, a cathode formed on the substrate having an emitter tip, a first insulating layer formed superadjacent the cathode, an extraction grid formed superadjacent the first insulating layer, the extraction grid having a distal surface with respect to the substrate, a focus ring formed superadjacent the extraction grid, the focus ring having a distal surface with respect to the substrate, the distal surface of the extraction grid and the distal surface of the focus ring being substantially planar proximate the emitter tip.

Placement of the focus ring in substantially the same plane as the extraction grid provides a number of benefits over the current design. In plane placement of the focus ring significantly reduces the dispersive effect the focus ring has on emitted electron beam. Use of the in-plane focus ring also permits the number of processing steps to be reduced from three etching steps and one CMP step, to either one or two etching steps and one CMP step, thereby saving substantial time and costs in the manufacturing process. One of the etching steps is performed before the CMP step. The optional second etching step is performed after the CMP step. The in-plane placement of the focus ring also permits a smaller spacing to be used between the focus ring and the gate structure which results in more overlap therebetween, thereby increasing the effectiveness of the focus ring layer as an opaque. The novel structure and process of the present invention also permits identical materials to be used for the extraction grid and the focus ring layer since these layers are no longer required to be selectively etchable with respect to one another. These and other benefits will become apparent to one skilled in the art from reading the detailed description and figures of the exemplary embodiments of the invention which follow.

DETAILED DESCRIPTION OF THE INVENTION

Figure 1:
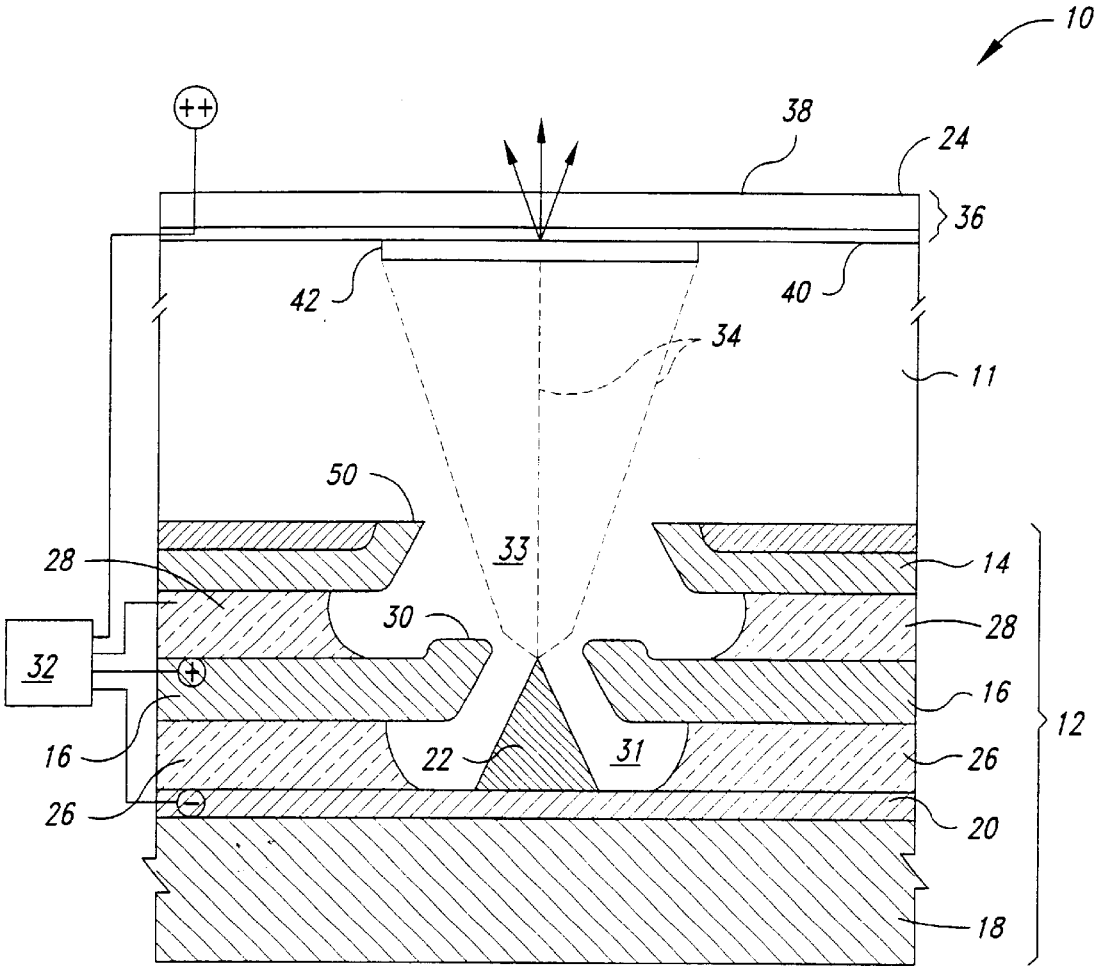
Fig. 1 (PRIOR ART)
FIG. 1 is a cross-sectional schematic drawing of a conventional flat panel display showing a field emission cathode and self-aligned focus ring.

In the following description, certain specific details are set forth in order to provide a thorough understanding of various embodiments of the present invention. However, one skilled in the art will understand that the present invention may be practiced without these details. In other instances, well-known structures associated with field emission displays and microelectronics fabrication have not been shown in detail in order to avoid unnecessarily obscuring the description of the embodiments of the invention. It will be understood by one skilled in the art that the field emission display 10 shown in the Figures is for illustrative purposes only, and is not drawn to scale Referring to FIG. 2, in an exemplary embodiment, a field emission display 10 includes a base plate 12 and a face plate 24 spaced from the base plate to define a sealed envelope 11 therebetween. The base plate 12 includes a substrate 18 which may be in the form of glass or any of a variety of other insulating materials, although a layer of single crystal silicon is preferred. A cold cathode conductor 20 is formed on the substrate 18 as a layer of conductive material, such as doped polycrystalline silicon. A plurality of conductive, conical emitters 22 are constructed on the cold cathode conductor layer 20. Only a single emitter 22 is shown in the figures to simplify the figures and the discussion, however, one skilled in the art would understand that there are often hundreds or even thousands of emitters supported on the substrate.

The base plate 12 further includes an extraction grid 16, formed from a conductive material and which is spaced from the cold cathode conductor layer 20 by a first insulating layer 26 formed of a dielectric material. A plurality of apertures 31 are defined through the extraction grid, each aperture 31 aligned with a respective one of the plurality of emitters 22. Again, only one aperture 31 is shown to simplify the figures and the discussion. A self-alignment process, discussed below, is often used during fabrication of the base plate 12 to ensure that the apertures 31 are in alignment with the emitters 22.

A focus ring layer 14 is spaced from the extraction grid 16 and the first insulating layer 26 by a second insulating layer 28 formed from a dielectric material. The focus ring layer 14 is formed from a conductive material, and has a plurality of apertures 33 formed therethrough, each of the apertures 33 aligned with a respective one of the plurality of emitters 22.

The face plate 24 includes a transparent substrate 38, such as glass, coated with a transparent layer of conductive material 40, such as iridium, forming an anode. The anode is, in turn, coated with a layer of cathodoluminescent material 42. Although a homogenous layer of cathodoluminescent material is illustrated in Figure, it will be understood that the layer of cathodoluminescent material may be composed of isolated areas of different types of cathodoluminescent material. For example, different cathodoluminescent materials may be used in different areas to provide a color field emission display.

In practice, the emitters 22 (which may be in sets of interconnected emitters) are arranged in columns while individual extraction grids 16 are arranged in rows. An individual emitter 22 can then be selected for electron emission by driving a column of emitters 22 to a relatively low voltage, for example, ground, and driving an extraction grid 16 row to a relatively high voltage, for example, 40 volts. Electrons 34 are emitted from the emitter 22 in the energized column of emitters 22 that intersects with the energized extraction grid 16 row.

A relatively high positive voltage on the order of 1000 volts is applied to the anode layer 40 through voltage source 32. The strong positive voltage attracts the electrons 34 emitted by the emitter 22 so that they pass through the focus ring 14 and strike the cathodoluminescent layer 42. The cathodoluminescent layer then emits light which is visible through the transparent substrate.

The invention can be best understood with reference to FIGS. 3–11 of the drawings which depict the initial, intermediate and final structures produced by a series of manufacturing steps according to an exemplary embodiment of the invention.

Figure 11:
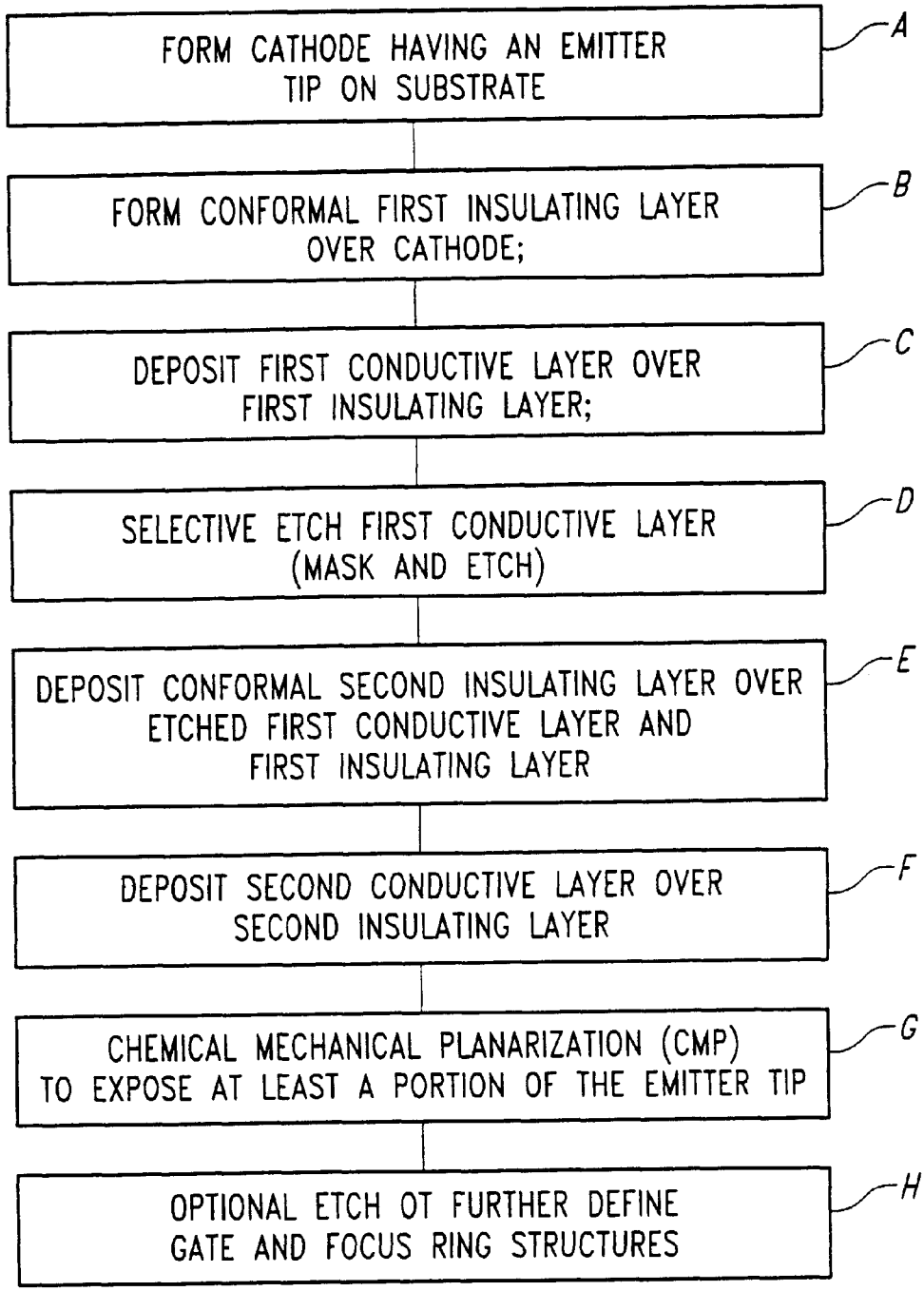
FIG. 11 is a flow diagram of the steps involved in the formation of the in-plane self-aligned gate and focus ring structures according to the present invention.

There are several methods by which to form the electron emitter tips 22 (Step A of FIG. 11). In practice, a single crystal p-type silicon wafer having formed therein, by a suitable known doping pretreatment, a series of elongated, parallel extending, opposite n-type conductivity regions or wells serves as the substrate. Each n-type conductivity strip has a width of approximately ten microns, and a depth of approximately three microns. The spacing of the strips is arbitrary, and can be adjusted to accommodate a desired number of field emission cathode sites to be formed on a given size silicon wafer substrate. Processing of the substrate to provide p-type and n-type conductivity regions may be by many well-known semiconductor processing techniques, such as diffusion and/or epitaxial growth. If desired, the p-type and n-type regions, of course, can be reversed through the use of suitable starting substrate and appropriate dopents.

The wells, having been implanted with ions will be the site of the emitter tips 22. A field emission cathode microstructure can be manufactured using the underlying single crystal, semiconductor substrate. The semiconductor substrate may be either p or n type and is selectively masked on one of its surfaces where it is desired to form field emission cathode sites. The masking is done in a manner such that the masked area defines islands on the surface of the underlying semiconductor substrate 18. Thereafter, selected sidewise removal of the underlying peripheral surrounding regions of the semiconductor substrate beneath the edges of the masked island areas results in the production of a sensually disposed, raised, single crystal semiconductor field emitter tip in the region immediately under each masked island area defining a field emission cathode site. It is preferred that the removal of underlying peripheral surrounding regions of the semiconductor substrate be closely controlled by oxidation of the surface of the semiconductor substrate surrounding the masked island areas with the oxidation phase being conducted sufficiently long to produce sideways growth of the resulting oxide layer beneath the peripheral edges of the masked areas to an extent required to leave only a non-oxidized tip of underlying, single crystal substrate beneath the island mask. Thereafter, the oxide layer is differentially etched away at least in the regions surrounding the masked island areas to result in the production of a sensually disposed, raised, single crystal semiconductor field emitter tip integral with the underlying single, crystal semiconductor substrate at each desired field emission cathode site.

Before beginning the gate formation process, the tip of the electron emitter 22 may be sharpened through an oxidation process. The surface of the silicon wafer 18 and the emitter tip 22 are oxidized to produce an oxide layer of $SiO_2$, which is then etched to sharpen the tip. Any conventional, known oxidation process may be employed in forming the $SiO_2$, in etching the tip.

The next step (Step B of FIG. 11) is the deposition of a conformal first insulating layer 26 that is composed of a dielectric insulating material which is selectively etchable with respect to the conductive gate material. In the preferred embodiment, a tetra-eythl-ortho-silicate (TEOS) layer 26 is used. Other suitable selectively etchable materials, including but not limited to, silicon dioxide, silicon nitride, and silicon oxynitride may also be used. The thickness of this first insulating layer 26 will substantially determine both the gate-to-cathode spacing, as well as the gate-to-substrate spacing. Hence, the first insulating layer 26 must be as thin as possible, since small distances from the gate 30 to the cathode 20 result in lower emitter drive voltages, at the same time, the first insulating layer 26 must be large enough to prevent the oxide breakdown which occurs if the gate 30 is not adequately spaced from the cathode conductor 20. The first insulating layer 26 is deposited on the emitter tip 22 in a manner such that the first insulating layer 26 conforms to the preferably conical shape of the cathode emitter 22.

Figure 5:
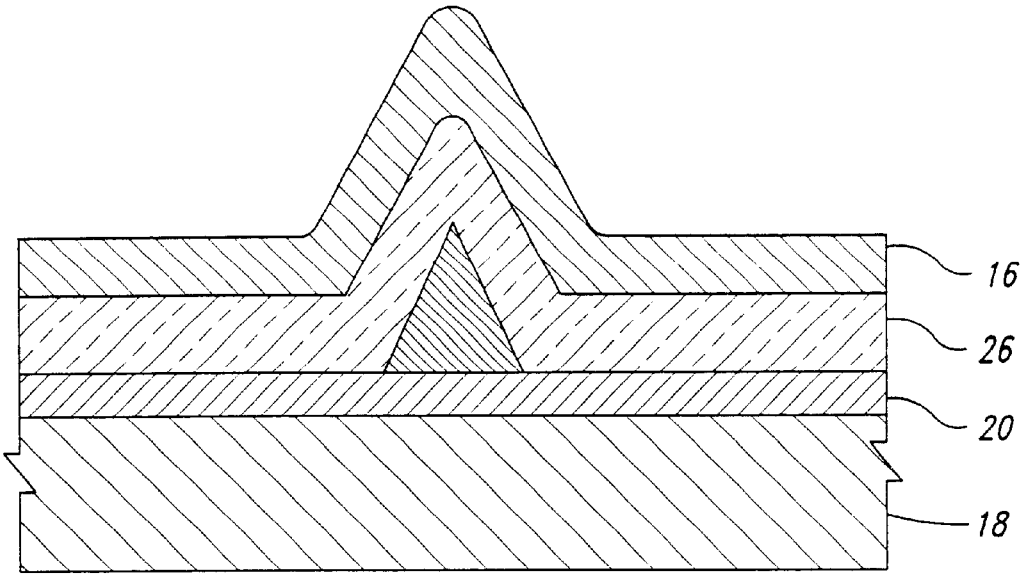
FIG. 5 shows the field emission cathode of FIG. 4 on which has been deposited a first conductive layer.

With reference to FIG. 5, the extraction grid 16 is formed as a first conductive layer deposited over the first insulating layer 26 (Step C of FIG. 11). The extraction grid 16 is formed by the deposition of a conductive gate material. Suitable conductive materials include, but are not limited to, a doped or silicided polysilicon and metals, such as chromium or molybdenum (Mo). Tungsten (W) is the preferred material for the extraction grid 16.

Figure 6:
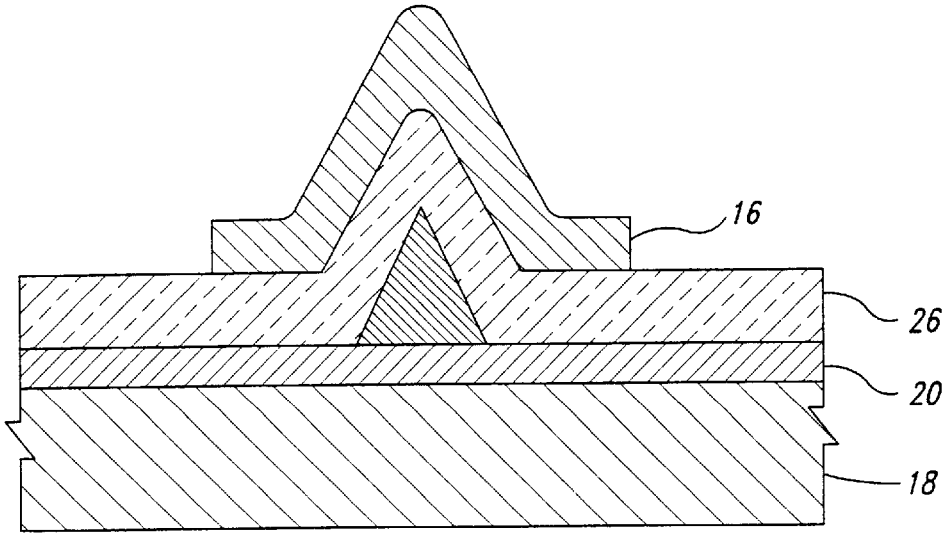
FIG. 6 shows the field emission cathode of FIG. 5 after etching to define a gate structure.

The next step (Step D of FIG. 11), as shown in FIG. 6, is the masking and selective etching of the first conductive layer 26. The selective etching is used to form the outer perimeter of the gate structure 30. It is this step which permits the focus ring layer 14 to be located in a substantially planar fashion to the extraction grid 16.

Figure 2:
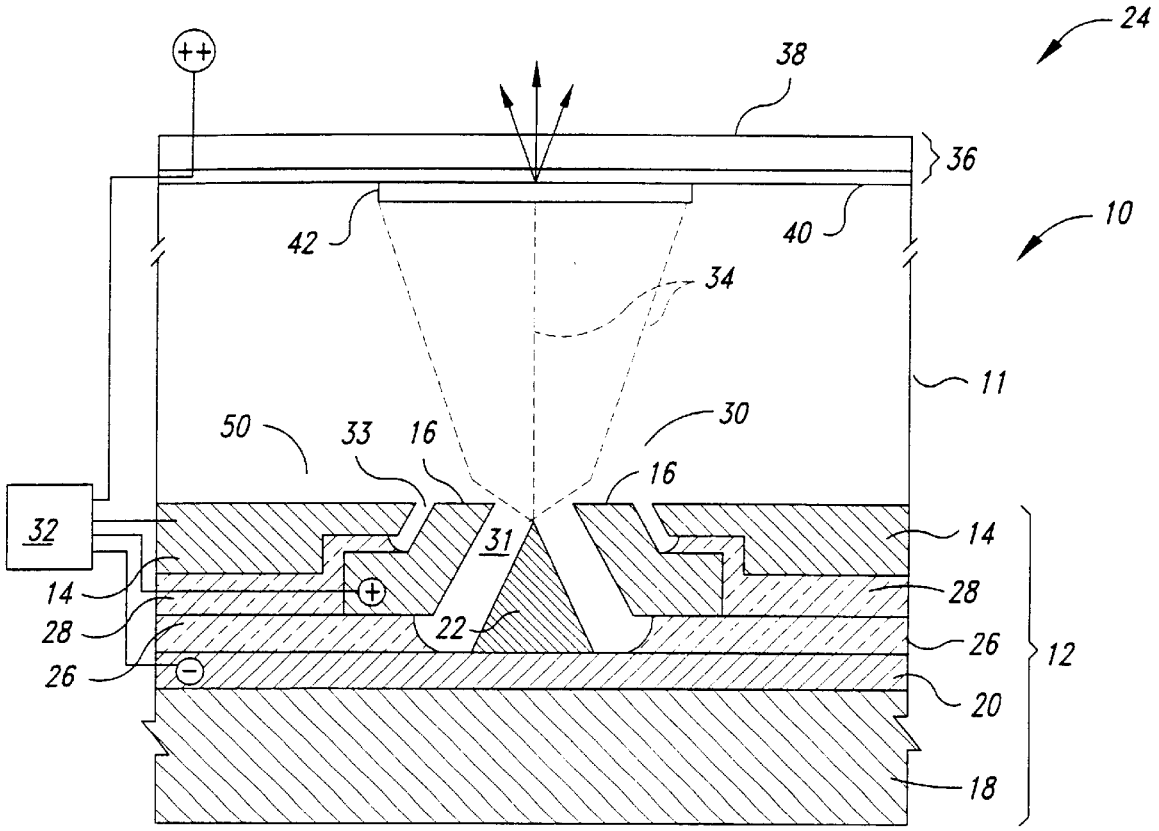
FIG. 2 is a cross-sectional schematic drawing of an exemplary embodiment of the flat panel display having an in-plane focus ring structure.
Figure 3:
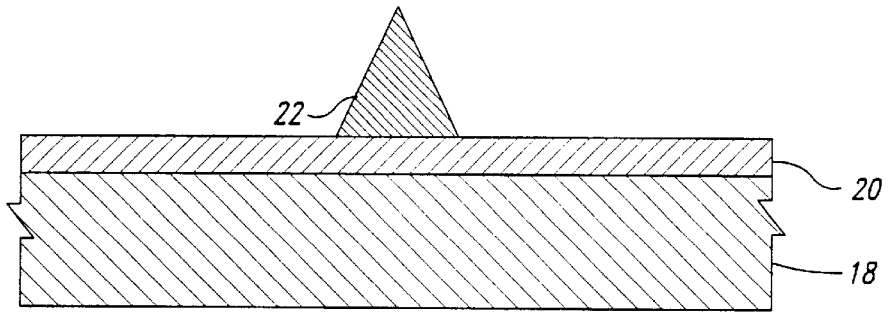
FIG. 3 shows a field emission cathode having a substantially conical emitter tip which has been deposited on a substrate.
Figure 4:
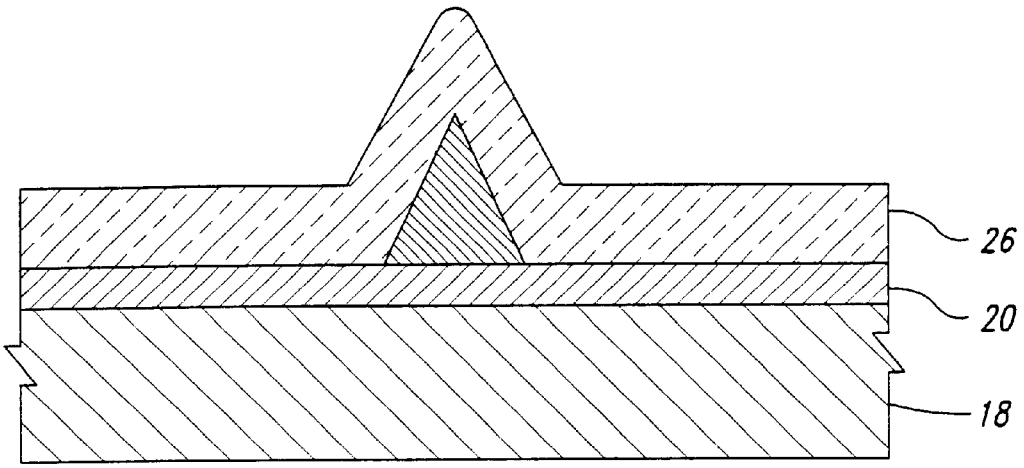
FIG. 4 shows a field emission cathode, having a substantially, conical emitter tip on which has been deposited a first insulating layer.
Figure 7:
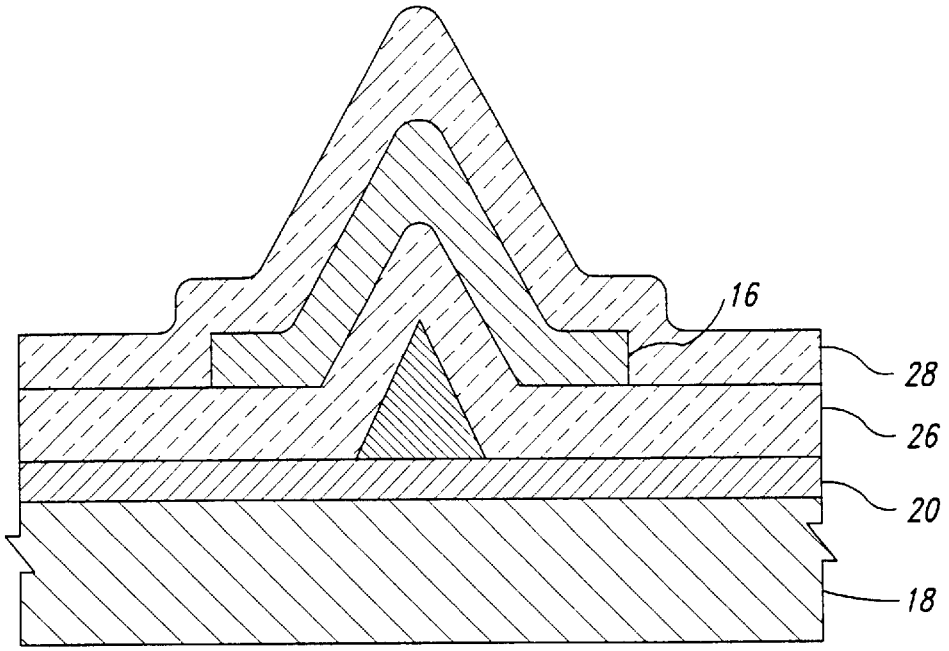
FIG. 7 shows the field emission cathode of FIG. 6 on which a second insulating layer has been deposited.

As shown in FIG. 7, at this stage in the fabrication (Step E of FIG. 11), a second conformal insulating layer 28 composed of a dielectric material is deposited. The dielectric insulating material may comprise TEOS, silicon dioxide, silicon nitride, silicon oxynitride, as well as, any other suitably selectively etchable material, although $SiO_3$ is preferred. The second insulating layer 28 substantially determines the spacing between the gate 30 and the focus ring layer 14 (FIG. 2).

Figure 8:
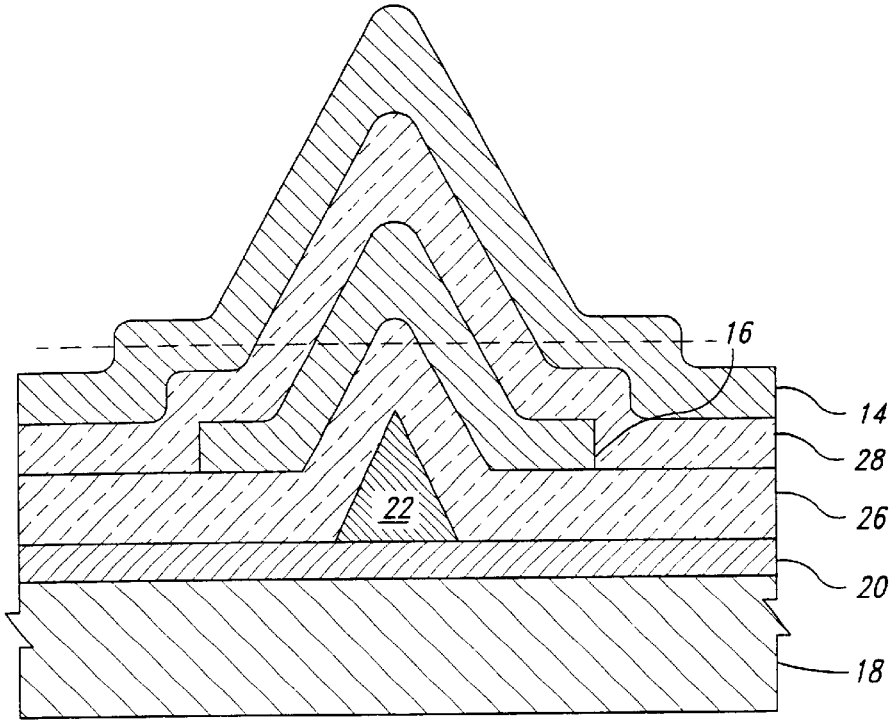
FIG. 8 shows the field emission cathode of FIG. 7 on which a second conductive layer or focus ring has been deposited.
Figure 9:
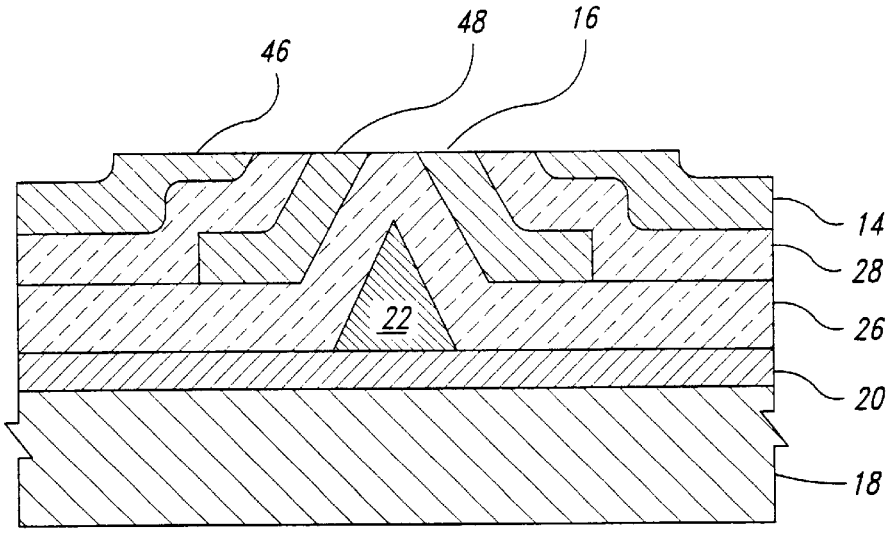
FIG. 9 shows the field emission cathode of FIG. 8 after it has undergone chemical mechanical planarization.

In the next process step (Step F of FIG. 11), a focus ring electrode layer 14 is deposited over the second insulating layer 28, as shown in FIG. 8. The selif-aligned focus ring structures 50 will be formed from the focused ring layer 14. The focus ring layer 14 forms a second conductive layer which may be comprised of a doped or silicided polysilicon or a metal, such as chromium or molybdenum (Mo), but as in the case with the first conductive layer 16, the preferred material is tungsten (W). Tungsten is preferred as the conductive material due to its broad spectrum of protection against x-ray and visible light magnetic radiation. It should be noted that the novel structure and process of the present invention permits identical materials to be used for the extraction grid 16 and the focus ring layer 14 since these layers are no longer required to be selectively etchable with respect to one another.

The next step (Step G of FIG. 11) is the chemical and mechanical planarization (CMP) of the resulting structure, also referred to in the art as chemical mechanical polishing (CMP). Through the use of chemical and abrasive techniques, multiple layers of the structure are polished away. In general, CMP involves holding or rotating a wafer or semiconductor material against a wetted polishing surface under controlled chemical slurry, pressure, and temperature conditions. A chemical slurry containing a polishing agent such as alumina or silica may be utilized as the abrasive medium. Additionally, the chemical slurry may contain chemical etchants. This procedure may be used to produce a surface with a desired endpoint or thickness, which also has a polished and planarized surface. Such apparatus for polishing are well-known in the art.

CMP will be performed substantially over the entire wafer surface, and at high pressure. Initially, CMP will proceed at a very fast rate, as the peaks are being removed, then the rate will slow dramatically after the peaks have been substantially removed. The removal rate of the CMP is proportionally related to the pressure and hardness of the surface being planarized. Planarization will proceed until at least a portion of the emitter tip 22 is exposed. The depth of planarization will determine both the width and the height of the gate structure 30. The CMP process also ensures that a distal surface 46 of the focus ring structure 44 is substantially planar with a distal surface 48 of the gate structure 30. The CMP process thus results in the formation of the self-aligned gate structure 30. Additionally, the CMP process results in an in-plane, self-aligned focus ring gate structure 50.

Figure 10:
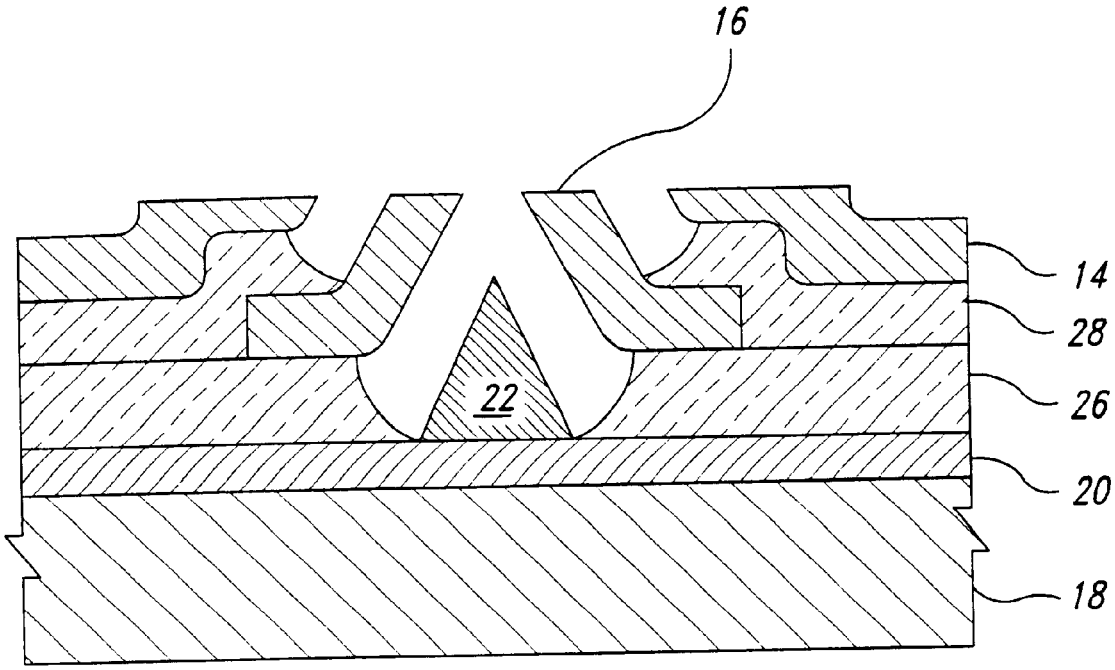
FIG. 10 shows the field emission cathode of FIG. 9 after wet etching to define the gate and focus ring structures.

The gate 30 and focus ring 50 formation are completed through an optional selective etching step (Step H of FIG. 11). With reference to FIG. 10, the first insulating layer 26 and second insulating layer 28 are selectively etched to further expose the emitter tip 22, as well as, a portion of the extraction grid 16 and focus ring layer 14.

Although specific embodiments of, and examples for, the present invention are described herein for illustrative purposes, various equivalent modifications can be made without departing from the spirit and scope of the invention, as will be recognized by those skilled in the relevant art. The teachings provided herein of the present invention can be applied to other field emission devices, not necessarily the exemplary field emission display generally described above.

These and other changes can be made to the invention in light of the above-detailed description. In general, in the following claims, the terms used should not be construed to limit the invention to the specific embodiments disclosed in the specification and the claims, but should be construed to include all field emission display systems that operate in accordance with the claims to provide a method for manufacturing such displays. Accordingly, the invention is not limited by the disclosure, but instead its scope is to be determined entirely by the following claims.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method for fabricating a base plate for a field emission device, the method comprising:

forming a first conductive layer on a substrate, the first conductive layer having a plurality of emitters formed thereon;

forming a first insulating layer over the first conductive layer;

forming a second conductive layer superjacent the first insulating layer;

removing the second conductive layer from the first insulating layer except in areas overlaying the emitters;

after moving the second conductive layer from the first insulating, forming a second insulating layer superjacent the second conductive layer and superjacent the area in which the second conductive layer has been removed;

forming a third conductive layer superjacent the second insulating layer;

planarizing the second conductive layer, the second insulating layer and the third conductive layer to a level that reaches the first insulating layer but does not reach the emitters so that at least a portion of the third conductive layer is planar with at least a portion of the second conductive layer; and coupling a first voltage to the second conductive layer and a second voltage to the third conductive layer.

2. The method of claim 1, further comprising selectively etching the first and the second insulating layers to define a cavity in the first insulating layer adjacent the emitter and a cavity in the second insulating layer between the second conductive layer and the third conductive layer.

3. The method of claim 2 wherein the act of selectively etching the first and the second insulating layers to define a cavity in the first insulating layer and a cavity in the second insulating layer comprises simultaneously etching the first and the second insulating layers to define the cavity in the first insulating layer and the cavity in the second insulating layer.

4. The method of claim 1, further comprising selectively etching the first and the second insulating layers to define a gate structure and a focus ring structure, respectively, wherein the first and second insulating layers are selectively etachable with respect to the second and the third conductive layers.

5. The method of claim 4 wherein the act of selectively etching the first and the second insulating layers define a gate structure and a focus ring structure, respectively, comprises simultaneously etching the first and the second insulating layers to define the gate structure and the focus ring structure, respectively.

6. The method of claim 1 wherein the act of forming the second conductive layer comprises depositing a first conductive material, and wherein the act of forming the third conductive layer comprises depositing the first conductive material.

7. The method of claim 1 wherein the act of forming the second conductive layer comprises depositing tungsten, and the act of forming the third conductive layer comprises depositing tungsten.

8. The method of claim 1, wherein the act of forming the first insulating layer comprises depositing a first dielectric material, and the act of forming the second insulating layer comprises depositing the first dielectric material.

9. The method of claim 1, wherein the act of forming a first insulating layer comprises depositing tetra-eythl-ortho-silicate; and the act of forming a second insulating layer comprises depositing tetra-eythl-ortho-silicate.

10. The method according to claim 1, wherein the act of forming a first insulating layer comprises depositing a first dielectric material, the first dielectric material being selectively etchable with respect to the first conductive material, and wherein the act of forming a second insulating layer comprises depositing the first dielectric material.

11. The method according to claim 1, wherein the act of planarizing at least some of the layers comprises planarizing at least some of the layers by chemical-mechanical planarization.

12. A method for fabricating a base plate for a field emission deive, the method comprising:

providing a substrate on which a plurality of emitters are formed;

depositing a first insulative layer on the substrate;

depositing a second conductive layer from the first insulative layer except in areas overlaying the emitters;

after removing the second conductive layer from the first insulative layer, depositing a second insulative layer on at least a portion of the second conductive layer and on areas of the first insulative area in which the second conductive layer has been removed;

depositing a third conductive layer on the second insulative layer;

planarizing the second conductive layer, the second insulative layer and the third conductive layer to a level that reaches the first insulative layer but does not reach the emitters so that a least a portion of the third conductive layer is planar with at least a portion of the second conductive layer; and coupling a first voltage to the second conductive layer and a second voltage to the third conductive layer.

13. The method of claim 12, further comprising forming a first cavity in the first insulative layer adjacent the emitter.

14. The method of claim 13, further comprising forming a second cavity in the second insulative layer between the second conductive layer and the third conductive layer.

15. The method of claim 13, wherein the act of forming a first cavity in the first insulative layer adjacent the emitter comprises selectively etching the first insulative layer to a define the first cavity.

16. The method of claim 12, further comprising selectively etching the first and the second insulative layers to define a gate structure and a focus ring structure, respectively, wherein the first and the second insulative layers are selectively etchable with respect to the second and the third conductive layers.

17. The method of claim 16, wherein the act of selectively etching the first and the second insulative layers to define a gate structure and a focus ring structure, respectively, comprises simultaneously etching the first and the second insulative layers to define the gate structure and the focus ring structure, respectively.

18. The method according to claim 12 wherein the act of planarizing at least some of the layers comprises planarizing at least some of the layers by chemical-mechancial planarization.

19. A method for fabricating a base plate for use in a field emission display, the method comprising:

supplying a substrate having a cathode conductive layer and a plurality of emitters formed thereon;

forming a first insulative layer over the cathode conductive layer and the plurality of emitters;

forming an extraction grid layer over the first insulative layer;

etching the extraction grid layer to define a plurality of gate structures, each of the gates structures being substantially aligned with a respective one of the plurality of emitters;

forming a second insulative layer over the etched extraction grid layer and the first insulative layer;

forming a focus ring layer over the second insulative; and planarizing at least some of the layers to an endpoint at which the emitters are at least partially exposed.

20. The method according to claim 19 wherein the act of planarizing at least some of the layers comprises planarizing at least some of the layers by chemical-mechanical planarization.

21. The method of claim 19 further comprising selectively etching the first and the second insulative layers to define cavities adjacent the emitters, the first and the second insulative layers being selectively etchable with respect to the extraction grid and focus ring layers.

22. The method of claim 19, wherein the act of forming an extraction grid layer comprises depositing a layer of conducting material, and the act of forming a focus ring layer comprises depositing the conducting material deposited to form the extraction grid.

23. The method of claim 22, wherein the acts of depositing a layer of a conducting material to form the extraction grid layer and depositing a layer of a conducting material to form the focus ring layer comprises depositing respective layers of tungsten.

24. The method of claim 19, wherein the act of forming a first insulative layer comprises depositing a dielectric materialand the act of forming a second insulative layer comprises depositing the dielectric material deposited to form the first insulative layer.

25. A method for fabricating a base plate for a field emission device, the method comprising:

forming a first conductive layer on substrate, the first conductive layer having a plurality of emitters formed thereon;

forming a first insulating layer superjacent the first conductive layer;

forming a second conductive layer superjacent the first insulating layer;

removing the second conductive layer from the first insulating layer except in areas overlaying the emitters;

after removing the second conductive layer from the first insulative layer, depositing a second insulating layer superjacent the second conductive layer and superjacent areas of the first insulating area in which the second conductive layer has been removed;

forming a third conductive layer superjacent the second insulating layer;

planarizing the second conductive layer, the second insulating layer and the third conductive layer to a level that reaches the first insulating layer but does not reach emitters so that at least a portion of the third conductive layer is planar with at least a portion of the second conductive layer; and simultaneously forming a first insulating layer adjacent the emitter and a second cavity in the second insulating layer between the second conductive layer and the third conductive layer by simultaneously etching the first insulating layer and the second insulating layer.

26. The method of claim 25 wherein the act of forming the second conductive layer comprises depositing a first layer of a first conductive material, and wherein the act of forming the third conductive layer comprises depositing a second layer of the first conductive material.

27. The method of claim 26 wherein the acts of depositing the first and second layers of a first conductive material comprises depositing first and second layers of tungsten.

28. The method of claim 25 wherein the act of forming the first insulating layer comprises depositing a first layer of a first dielectric material, and the act of forming the second insulating layer comprises depositing a second layer of the first dielectric material.

29. The method of claim 28 wherein the acts of depositing the first and second layers of a first insualting layer comprises depositing first and second layers of tetra-eythl-orthosilicate.

30. The method according to claim 25 wherein the act of forming a first insulating layer comprises depositing a first dielectric material that is selectively etchable with respect to the first conductive material, and wherein the act of forming a second insualting layer comprises depositing a second dielectric material that is selectively etchable with respect to the second conductive material.

31. The method according to claim 25 wherein the act of planarizing comprises planarizing by chemical-mechanical planarization.

32. The method of claim 25 further comprising coupling a first voltage to the second conductive layer and a second voltage to the third conductive layer.

33. A method for fabricating a base plate for a field emission device, the method comprising:

providing a substrate on which a plurality of emitters are formed;

depositing a first insulating layer on the substrate;

depositing a second conductive layer on the first insulating layer;

removing the second conductive layer from the first insulating layer except in areas overlaying the emitters;

after removing the second conductive layer from the first insulating layer, depositing a second insulating layer on at least a portion of the second conductive layer and on areas of the first insulating area in which the second conductive layer has been removed;

depositing a third conductive layer on the second insulating layer;

planarizing the second conductive layer, the second insulating layer and the third conductive layer to a level that reaches the first insulating layer but does not reach the emitters so that at least a portion of the third conductive layer is planar with at least a portion of the second conductive layer; and simultaneously forming a first cavity in the first insualting layer adjacent the emitter and a second cavity in the second insulating layer between the second conductive layer and the third conductive layer by simultaneously etching the first insulating layer and the second insulating layer.

34. The method of claim 33, wherein the act of forming the second conductive layer comprises depositing a first layer of a first conductive material, and wherein the act of forming the third conductive layer comprises depositing a second layer of the first conductive material.

35. The method of claim 34 wherein the acts of depositing the first and second layers of a conductive material comprises depositing first and second layers of tungsten.

36. The method of claim 33 wherein the act of forming the first insulating layer comprises depositing a first layer of a first dielectric material, and the act of forming the second insulating layer comprises depositing a second layer of the first dielectric material.

37. The method of claim 36 wherein the acts of depositing the first and second layers of a first insulating layer comprises depositing first and second layers of tetra-eythl-orthosilicate.

38. The method according to claim 33 wherein the act of forming a first insulating layer comprises depositing a first dielectric material that is selectively etchable with respect to the first conductive material, and wherein the act of forming a second insulating layer comprises depositing a second dielectric material that is selectively etchable with respect to the second conductive material.

39. The method according to claim 33 wherein the act of planarizing comprises planarizing by chemical-mechanical planarization.

40. The method of claim 33 further comprising coupling a first voltage to the second conductive layer and a second voltage to the third conductive layer.

* * * * *

UNITED STATES PATENT AND TRADEMARK OFFICE

CERTIFICATE OF CORRECTION

PATENT NO. : 6,428,378 B2 
DATED : August 6, 2002
INVENTOR(S) : Kevin W. Tjaden and Terry N. Williams It is certified that error appears in the above-identified patent and that said Letters Patent is hereby corrected as shown below:

Title page,
Item [56], References Cited, U.S. PATENT DOCUMENTS, reads "Spindt ….313/39" should read -- Spindt….313/309 --
OTHER PUBLICATIONS, reads "Devices society," should read -- Devices Society, --

Column 1,
Line 8, reads "Ser. No. 09/109/955" should read -- Ser. No. 09/109,955 --

Column 2,
Line 13, reads "as well, as cathode" should read -- as well as cathode --
Line 27, reads "space-charge affect" should read -- space-charge effect --
Line 35, reads "of focus" should read -- of the focus --

Column 3,
Line 11, reads "In plane placement" should read -- In-plane placement --
Line 13, reads "electron beam." should read -- electron beams. --
Line 44, reads "substantially, conical" should read -- substantially conical --

Column 4,
Line 48, reads "illustrated in Figure, it" should read -- illustrated in FIG. 2, it --

Column 5,
Line 26, reads "appropriate dopents." should read -- appropriate dopants. --

Column 6,
Line 8, reads "drive voltages, at the" should read -- drive voltages. At the --
Line 22, reads "as well as, a portion" should read -- as well as a portion --
Line 34, reads "as well as, any" should read -- as well as any --
Line 41, reads "The selif-aligned" should read -- The self-aligned --

Column 7,
Line 55, reads "layer over the" should read -- layer superjacent the --
Line 60, reads "in areas overlaying" should read -- in areas overlying --
Line 61, reads "after moving the" should read -- after removing the --
Line 62, reads "insulating, forming" should read -- insulating layer, forming --

UNITED STATES PATENT AND TRADEMARK OFFICE

CERTIFICATE OF CORRECTION

PATENT NO. : 6,428,378 B2 
DATED : August 6, 2002
INVENTOR(S) : Kevin W. Tjaden and Terry N. Williams It is certified that error appears in the above-identified patent and that said Letters Patent is hereby corrected as shown below:

Column 8,
Line 60, reads "emission deive," should read -- emission device, --
Line 64, reads "layer from" should read -- layer on the first insulative layer; removing the second conductive layer from --

Column 9,
Line 61, reads "of claim 19 further" should read -- of claim 19, further --

Column 10,
Line 11, reads "materialand the" should read -- material and the --
Line 16, reads "layer on substrate" should read -- layer on a substrate --
Line 25, reads "areas overlaying" should read -- areas overlying --
Line 27, reads "layer, depositing" should read -- layer, forming --
Line 39, reads "forming a first" should read -- forming a first cavity in the first --

Column 11,
Line 15, reads "areas overlaying" should read -- areas overlying --
Line 29, reads "the first insualting" should read -- first insulating --

Column 12,
Line 7, reads "of a conductive" should read -- of a first conductive --
Line 30, reads "of claim 33 further" should read -- of claim 33, further --

Signed and Sealed this

Sixth Day of May, 2003

JAMES E. ROGAN
*Director of the United States Patent and Trademark Office*